US009723416B2

(12) United States Patent
Babico

(10) Patent No.: US 9,723,416 B2
(45) Date of Patent: Aug. 1, 2017

(54) HEARING ASSISTANCE DEVICES AND USER INTERFACES FOR USE WITH SAME

(71) Applicant: Advanced Bionics AG, Staefa (CH)

(72) Inventor: John Y. Babico, Tuscon, AZ (US)

(73) Assignee: Advanced Bionics AG, Staefa (CH)

( * ) Notice: Subject to any disclaimer, the term of this patent is extended or adjusted under 35 U.S.C. 154(b) by 0 days.

(21) Appl. No.: 15/021,261

(22) PCT Filed: Sep. 18, 2013

(86) PCT No.: PCT/US2013/060298

§ 371 (c)(1),
(2) Date: Mar. 10, 2016

(87) PCT Pub. No.: WO2015/041639

PCT Pub. Date: Mar. 26, 2015

(65) Prior Publication Data

US 2016/0227333 A1 Aug. 4, 2016

(51) Int. Cl.
*H04R 25/00* (2006.01)

(52) U.S. Cl.
CPC ..... *H04R 25/65* (2013.01); *H04R 25/50* (2013.01); *H04R 25/55* (2013.01); *H04R 25/60* (2013.01); *H04R 2225/021* (2013.01); *H04R 2225/61* (2013.01)

(58) Field of Classification Search
CPC ..... H04R 25/60; H04R 25/65; H04R 25/50; H04R 25/55; H04R 2225/021; H04R 225/61; H01H 3/12; H01H 13/14
USPC ..... 200/341, 520
See application file for complete search history.

(56) References Cited

U.S. PATENT DOCUMENTS

| | | | | |
|---|---|---|---|---|
| 4,672,672 | A * | 6/1987 | Eggert | H04R 25/60 381/321 |
| 5,059,939 | A * | 10/1991 | Wu | H01C 10/12 338/139 |
| 5,341,433 | A | 8/1994 | Meyer et al. | |
| 7,248,142 | B2 | 7/2007 | Beck et al. | |
| 7,507,920 | B2 | 3/2009 | Erbe | |
| 2006/0185969 | A1* | 8/2006 | Erbe | H01H 1/5805 200/14 |
| 2009/0123013 | A1 | 5/2009 | Leong | |

FOREIGN PATENT DOCUMENTS

| | | | |
|---|---|---|---|
| EP | 1496530 | A2 | 1/2005 |
| EP | 1983803 | A1 | 10/2008 |
| WO | WO 95/13744 | A1 | 5/1995 |

OTHER PUBLICATIONS

PCT International Search and Written Opinion dated Apr. 25, 2014 for PCT App. Ser. No. PCT/US2013/060298.

* cited by examiner

*Primary Examiner* — Tuan D Nguyen
(74) *Attorney, Agent, or Firm* — Henricks, Slavin & Holmes LLP

(57) ABSTRACT

A hearing assistance device including a housing, a user manipulatable control element, and a printed circuit board having a flexible substrate, sound processor circuitry on the flexible substrate, and a variable resistor that is an integral part of the printed circuit board and/or is secured to the housing.

30 Claims, 7 Drawing Sheets

HEARING ASSISTANCE DEVICES AND USER INTERFACES FOR USE WITH SAME

CROSS-REFERENCE TO RELATED APPLICATIONS

This application is the U.S. National Stage of PCT App. Ser. No. PCT/US2013/060298, filed Sep. 18, 2013.

BACKGROUND

1. Field

The present disclosure relates generally to hearing assistance devices such as, for example, implantable cochlear stimulation ("ICS") systems and hearing aids.

2. Description of the Related Art

A wide variety of hearing assistance devices are available. Such devices include, but are not limited to, ICS systems and hearing aids.

ICS systems are used to help the profoundly deaf perceive a sensation of sound by directly exciting the auditory nerve with controlled impulses of electrical current. Ambient sound pressure waves are picked up by an externally worn microphone and converted to electrical signals. The electrical signals, in turn, are processed by sound processor circuitry, converted to a pulse sequence having varying pulse widths and/or amplitudes, and transmitted to an implanted receiver circuit of the ICS system. The implanted receiver circuit is connected to an implantable electrode array that has been inserted into the cochlea of the inner ear, and electrical stimulation current is applied to varying electrode combinations to create a perception of sound. A representative ICS system is disclosed in U.S. Pat. No. 5,824,022, which is entitled "Cochlear Stimulation System Employing Behind-The-Ear Sound processor With Remote Control" and incorporated herein by reference in its entirety.

As alluded to above, some ICS systems include an implantable device, a sound processor, with the sound processor circuitry, and a microphone that is in communication with the sound processor circuitry. The implantable device communicates with the sound processor and, to that end, some ICS systems include a headpiece that is in communication with both the sound processor and the implantable device. The microphone may be part of the sound processor or the headpiece. In one type of ICS system, the sound processor is worn behind the ear (a "BTE sound processor"), while other types of ICS systems have a body worn sound processor unit (or "body worn sound processor"). The body worn sound processor, which is larger and heavier than a BTE sound processor, is typically worn on the user's belt or carried in the user's pocket. Examples of commercially available ICS sound processors include, but are not limited to, the Advanced Bionics Harmony™ BTE sound processor.

Hearing aids include a microphone, sound processor circuitry, and a speaker (sometimes referred to as a "receiver"). Here too, ambient sound pressure waves are picked up by the microphone and converted into electrical signals. The electrical signals, in turn, are processed by sound processor circuitry. The processed signals drive the speaker, which delivers amplified (or otherwise processed) sound pressure waves to the ear canal. Exemplary types of hearing aids include, but are not limited to, BTE hearing aids, receiver-in-canal ("RIC") hearing aids, and in-the-canal ("ITC") hearing aids. Examples of commercially available hearing aids include, but are not limited to, the Phonak Ambra™ hearing aid and the Phonak Naida™ hearing aid.

Hearing assistance devices typically have a user interface that includes one or more user manipulatable elements such as switches and potentiometers, which facilitate adjustments to operating parameters such program and volume. The switches and potentiometers are part of a printed circuit board that is dedicated to user interface functionality, and user interface printed circuit board is connected to the main printed circuit board of the hearing assistance device by male and female connectors on the printed circuit boards.

The present inventor has determined that conventional hearing assistance device user interfaces are susceptible to improvement. For example, conventional user interface switches and potentiometers are prone to failure, as are the printed circuit board connectors, and frequently cause hearing assistance devices to be returned to the manufacturer for repair. The present inventor has also determined that it would be desirable to make user interface components smaller as this is one way to reduce the overall size of the hearing assistance device.

SUMMARY

A hearing assistance device in accordance with one of the present inventions includes a housing, a user manipulatable control element associated with the housing and movable relative to the housing, and a printed circuit board within the housing having a flexible substrate, sound processor circuitry on the flexible substrate, and a variable resistor that is an integral part of the printed circuit board. The variable resistor is positioned adjacent to the control element and is configured such that movement of the control element results in a change in variable resistor resistance.

A hearing assistance device in accordance with one of the present inventions includes a housing, a user manipulatable control element associated with the housing and movable relative to the housing, sound processor circuitry, and a variable resistor operably connected to the sound processor circuitry. The variable resistor includes a flexible substrate and a strip of conductive variable resistance material carried by the flexible substrate. A first portion of the flexible substrate is secured to the housing and a second portion of the flexible substrate is deflectable relative to the housing. The variable resistor is positioned adjacent to the control element and is configured such that movement of the control element results in deflection of the second portion of the variable resistor and a change in variable resistor resistance.

There are a number of advantages associated with such hearing assistance devices. For example, switches and potentiometers employing variable resistance resistors can be smaller and less likely to fail than conventional switches and potentiometers. The use of a single printed circuit board, instead of two connected printed circuit boards with one being the main board and the other providing the switch, also reduces the likelihood of failure and simplifies the assembly process.

The above described and many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF THE EXEMPLARY EMBODIMENTS

The following is a detailed description of the best presently known modes of carrying out the inventions. This description is not to be taken in a limiting sense, but is made merely for the purpose of illustrating the general principles of the inventions.

The present inventions have application in a wide variety of hearing assistance devices that provide sound (i.e., either sound or a perception of sound) to the hearing impaired as well as others who require such hearing devices on a situational basis. Examples of such hearing assistance devices include hearing aids and ICS systems where an external sound processor communicates with a cochlear implant. The present inventions are not, however, limited to ICS systems and hearing aids, and may be employed in combination with other hearing assistance devices that currently exist, or are yet to be developed.

Figure 1:
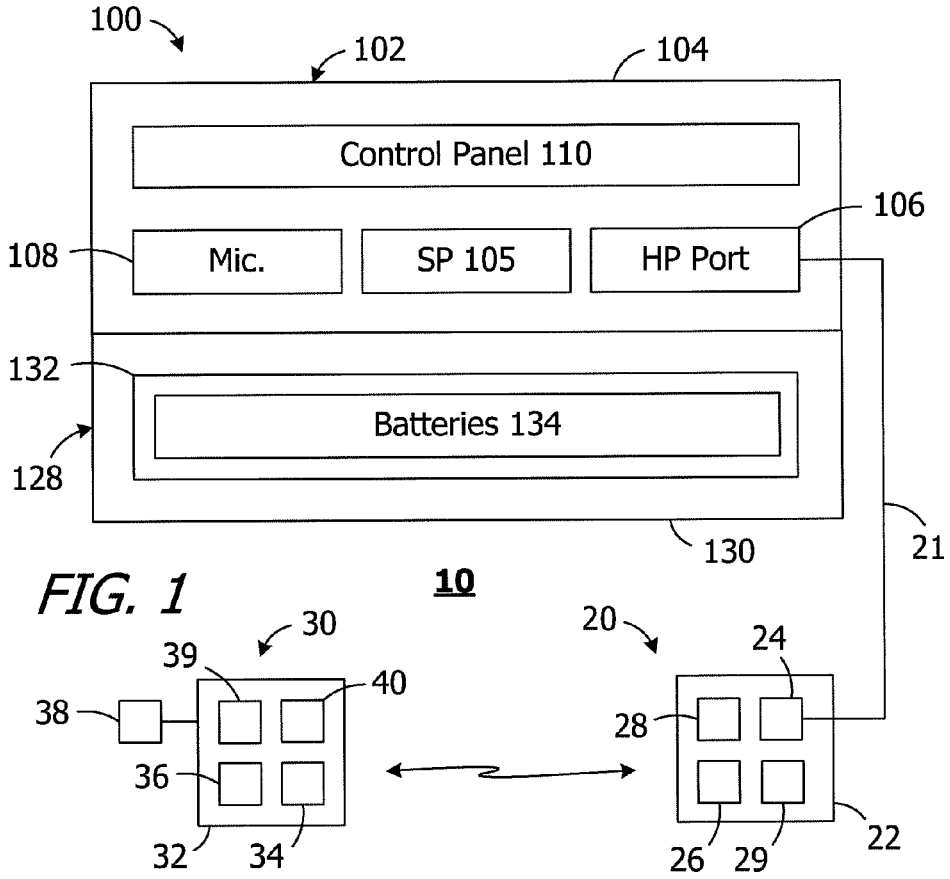
FIG. 1 is a functional block diagram of an ICS system in accordance with one embodiment of a present invention.

One example of a hearing assistance device is the ICS system generally represented by reference numeral 10 in FIG. 1. The exemplary ICS system 10 includes a BTE unit 100, a headpiece 20, and a cochlear implant 30.

Figure 2:
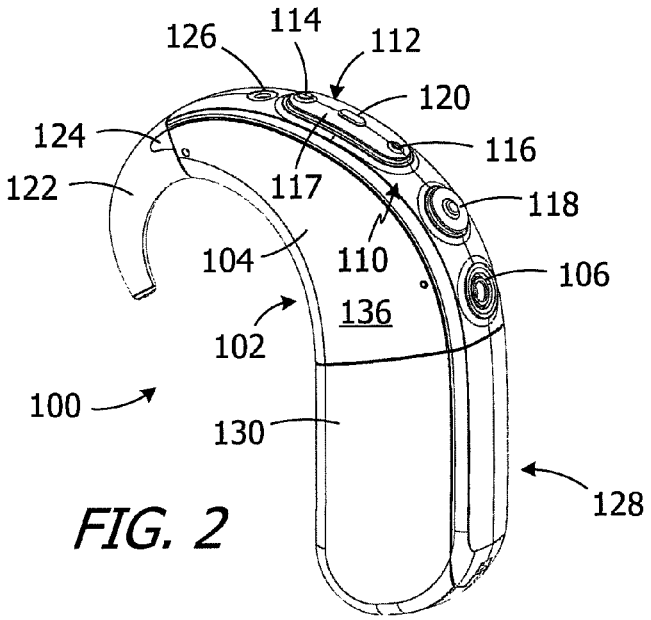
FIG. 2 is a perspective view of a BTE unit in accordance with one embodiment of a present invention.

Referring first to FIGS. 1 and 2, the exemplary BTE unit 100 includes a sound processor 102 with a processor housing 104 in which and/or on which various components are supported. Such components may include, but are not limited to, sound processor circuitry 105, a headpiece port 106, a microphone 108, and a control panel 110 with user manipulatable elements. The exemplary control panel 110 has a rocker-type volume control 112, with a pair of switches 114 and 116 that correspond to volume up and volume down and share a common pivotable outer member 117, a program selector switch 118, and an indicator light (e.g., an LED) 120. The sound processor circuitry 105, which is connected to the switches, increases the volume when switch 114 is actuated, decreases volume when switch 116 is actuated, and changes the program when switch 118 is actuated. An ear hook 122 with an indentation 124 may be secured to the housing 102. A sound port 126 for the microphone 108 extends through the housing 104 adjacent to the volume switch 112, and another sound port (not shown) extends through the housing adjacent to the earhook indentation 124. The BTE unit 100 also includes a power supply 128 that supplies power to the sound processor circuitry 105 and other power consuming components of the sound processor 102. The power supply 128 includes a power supply housing 130 and a battery holder 132 for removable batteries or other removable power supplies 134 (e.g., rechargeable and disposable batteries or other electrochemical cells). The battery holder 132 may be completely removable from the remainder of the power supply 128 in some instances, and partially removable to a point at which the batteries can be removed and replaced in other instances.

The exemplary headpiece 20 includes a housing 22, as well as various components, e.g., a RF connector 24, a transmitter (e.g., an antenna) 26 and a positioning magnet 28, that are carried by the housing. A headpiece microphone 29 may also be provided. The headpiece 20 in the exemplary ICS system 10 may be connected to the sound processor headpiece port 106 by a cable 21. It should be noted that, in other implementations, communication between a sound processor and a headpiece may be accomplished through wireless communication techniques.

The exemplary cochlear implant 30 includes a housing 32, a receiver (e.g., an antenna) 34, an internal processor 36, a cochlear lead 38 with an electrode array, a power supply 39, and a positioning magnet (or magnetic material) 40. The transmitter 26 and receiver 34 communicate by way of electromagnetic induction, radio frequencies, or any other wireless communication technology. The positioning magnet 28 and positioning magnet (or magnetic material) 40 maintain the position of the headpiece transmitter 26 over the cochlear implant receiver 34.

During use, the microphone 108 picks up sound from the environment and converts it into electrical impulses, and the sound processor 105 filters and manipulates the electrical impulses and sends the processed electrical signals through the cable 21 to the transmitter 26. Electrical impulses received from an auxiliary device are processed in essentially the same way. The receiver 34 receives signals from the transmitter 26 and sends the signals to the cochlear implant internal processor 36, which modifies the signals and passes them through the cochlear lead 38 to the electrode array. The electrode array may be wound through the cochlea and provides direct electrical stimulation to the auditory nerves inside the cochlea. This provides the user with sensory input that is a representation of external sound waves which were sensed by the microphone 108.

Figure 3:
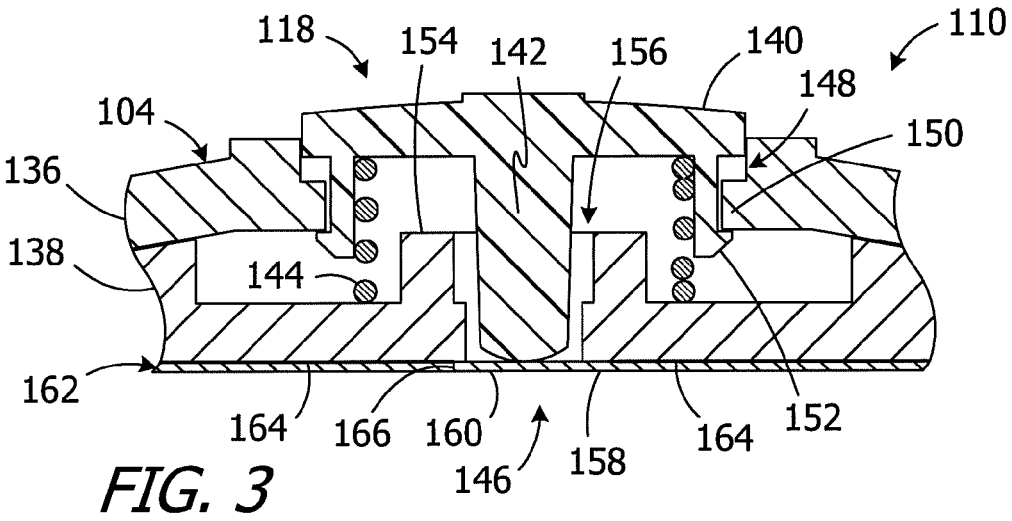
FIG. 3 is a section view of a switch in accordance with one embodiment of a present invention in a non-actuated state.
Figure 4:
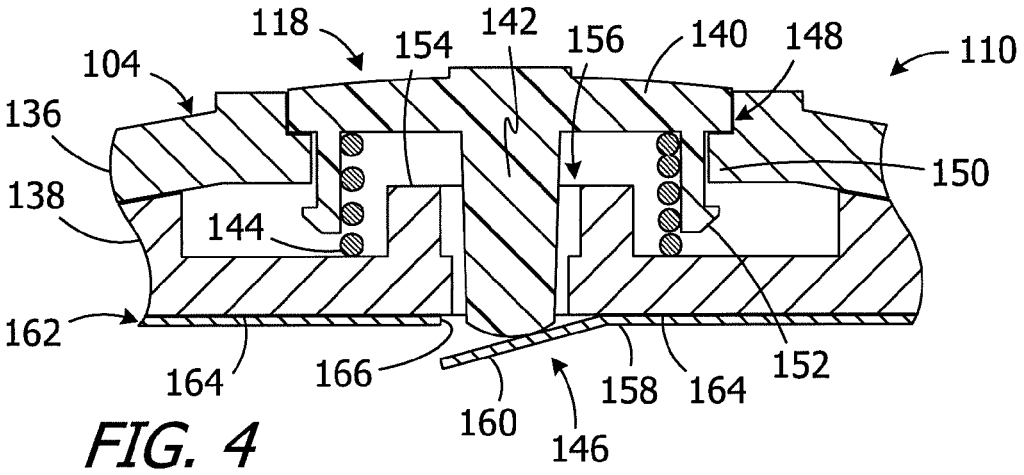
FIG. 4 is a section view of the switch illustrated in FIG. 3 in an actuated state.

Turning to FIGS. 3 and 4, the housing 104 in the exemplary embodiment includes an external member 136 and an internal support member 138. The external member 136 may be a unitary structure or may consist of a plurality of structures that are secured to one another during the assembly process. The internal support member 138 is located adjacent to the inner surface of the outer member 136. The outer member 136 and the internal support member 138 also form portions the control panel 110. To that end, the exemplary program selector switch 118 includes a movable push-button 140, a post 142 that is secured to the push-button, a spring 144 (or other biasing element) that biases the push-button to the non-actuated position illustrated in FIG. 3, and a deflectable resistor 146 whose resistance varies (e.g., increases) as it is deflected. The outer member 136 has an aperture 148 for the push-button 140 and a retaining ledge 150 for retaining clips 152 that are carried by the push-button. The internal support member 138 has a post 154 for centering the spring 144 during assembly and a lumen 156, that extends through the internal support member, for the post 142. The spring 144 is compressed between the top surface (in the illustrated orientation) of the internal support member 138 and the bottom surface of the push-button 140. The variable resistor 146 includes a fixed portion 158 and a movable portion 160 that bends relative to the fixed portion. The movable portion 160 of the variable resistor 146 is positioned under the internal support member 138 and is aligned with the lumen 156. So aligned, the post 142 will deflect the movable portion 160 of the variable resistor 146 when the button is pushed from the position illustrated in FIG. 3 to the position illustrated in FIG. 4, thereby changing the switch from the non-actuated state to the actuated state.

Figure 5:
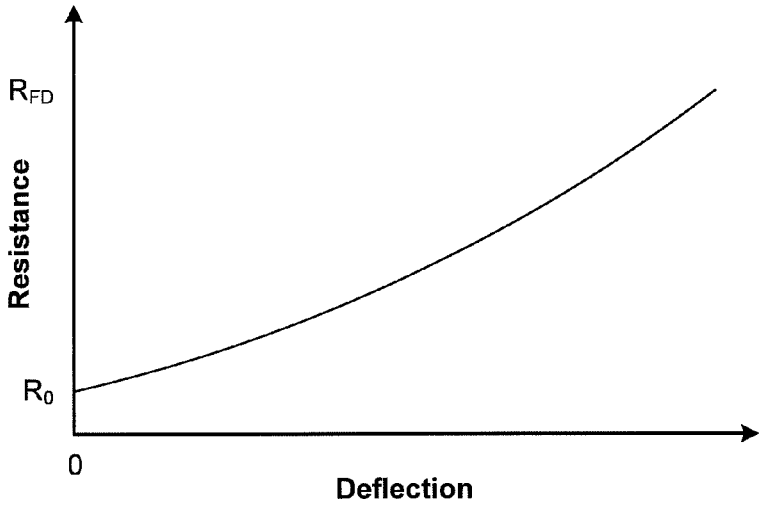
FIG. 5 is a deflection versus resistance graph.

The associated change in resistance of the variable resistor 146 may be used by the sound processor circuitry 105 to determine when the button has been pushed. To that end, FIG. 5 is a graph that illustrates how the resistance of the exemplary variable resistor 146 increases with deflection. The resistance of the variable resistor 146 when it is in the non-deflected (or "at rest") state illustrated in FIG. 3 is labeled $R_0$ and the resistance of the variable resistor 146 when it is in the fully deflected state illustrated in FIG. 4 is labeled $R_{FD}$. The resistance is converted into a voltage by applying current to the resistor, and the voltages changes as the resistance increases. In some circuits the voltage will increase as the resistance increases, while in other circuits the voltage will decrease as the resistance increases. In the illustrated implementation, the sound processor circuitry 105 will change the sound processing program each time the voltage indicates that the resistance at the variable resistor 146 has reached $R_{FD}$. If there are two programs, for example, the sound processor circuitry 105 will switch from one to the other each time the button 140 reaches the fully pressed position illustrated in FIG. 4, thereby actuating the switch 118. Partial presses of the button 140 will not result in program changes in this implementation.

It should also be noted that the variable resistor 146 is well suited for many types of user manipulatable control environments. For example, the variable resistor 146 is well suited for user manipulatable controls that are based on the momentary sensing of single resistance value (e.g., the switch 118 and resistance $R_{FD}$ described above with reference to FIGS. 3-5). The variable resistor 146 is also well suited for user manipulatable controls that are based on a range of sensed resistance values that may remain the static for long periods (e.g., the rotatable potentiometer 112*a* and resistances $R_0$ to $R_{FD}$ described below with reference to FIGS. 10-10B).

In the illustrated embodiment, the variable resistor 146 is part of a printed circuit board 162, which is discussed in greater detail below with reference to FIGS. 7-9. Briefly, the printed circuit board 162 is a flexible structure that is shaped and sized such that it may be folded and positioned within the housing 104. The portion of the printed circuit board 162 that includes the variable resistor 146 is secured to a portion of the housing 104 (i.e., the internal support member 138 in the illustrated embodiment) with adhesive 164 (FIGS. 3 and 4). The attached portion includes the variable resistor fixed portion 158. The movable portion 160 is not secured to the housing 104 or to the adjacent portions of the printed circuit board 162. To that end, the edges of the movable portion 160 are separated from the remainder of the printed circuit board 162 by slits or other discontinuities 166 that allow the movable portion 160 to move relative to the fixed portion 158 and the remainder of the printed circuit board 162.

Figure 6:
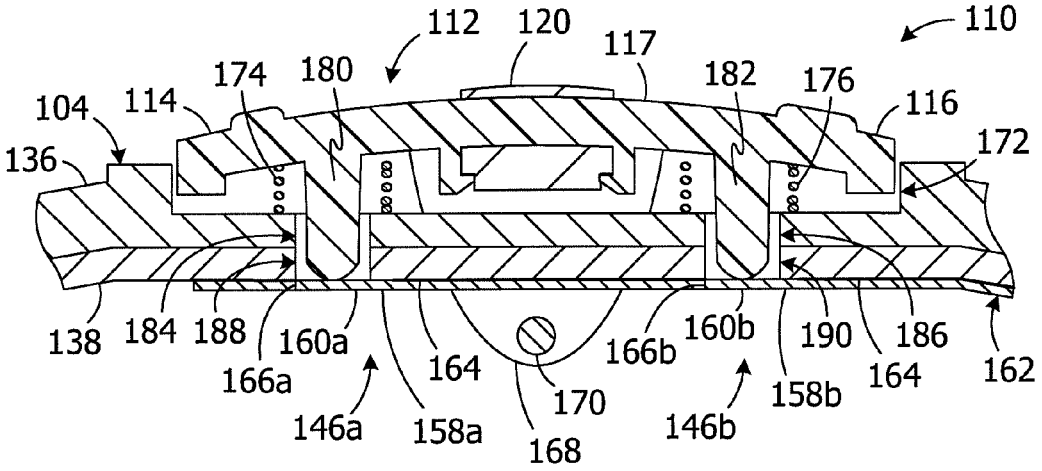
FIG. 6 is a section view of a rocker-type control with a pair of switches in accordance with one embodiment of a present invention in a non-actuated state.

Turning to FIG. 6, and as noted above, the exemplary rocker-type volume control 112 includes a pair of switches 114 and 116 that share a common outer member 117. The outer member 117, which has a pair of supports 168 (only one shown) that are pivotably connected to the housing 104 by a pivot pin 170, is positioned within a recess 172. The outer member 117 is biased to the non-actuated position illustrated in FIG. 6, where neither of the switches 114 and 116 is actuated, by springs 174 and 176. In addition to the common outer member 117, the switches 114 and 116, respectively, include posts 180 and 182 that, respectively, extend though springs 174 and 176, through apertures 184 and 186 in the housing external member 136, and through apertures 188 and 190 in the internal support member 138. The switches 114 and 116 are also provided with variable resistors 146*a* and 146*b*. The variable resistors 146*a* and 146*b*, which have fixed portions 158*a* and 158*b* and movable portions 160*a* and 160*b*, are essentially identical to variable resistor 146 described in connection with FIGS. 3-5. The variable resistors 146*a* and 146*b* are also part of the printed circuit board 162 and are partially separated therefrom by slits or other discontinuities 166*a* and 166*b* so that the movable portions 160*a* and 160*b* can deflect relative to the remainder of the printed circuit board 162. Actuation of the switches 114 and 116 occurs in essentially the same way as switch 118. The outer member 117 pivots about the pin 170 when one of the ends is pushed. The post 180 (or 182) that is associated with the pushed end will then deflect the adjacent variable resistor 146*a* (or 146*b*) from the non-actuated position to the actuated position. The spring 174 (or 176) will return the outer member 117 to the illustrated non-actuated position upon release.

The resistances of the variable resistors 146*a* and 146*b* are $R_0$ when they are in the non-deflected (or "at rest") state and $R_{FD}$ when they are in the fully deflected state. The resistances are converted into voltages in the manner described above. In the illustrated implementation, the sound processor circuitry 105 will increase the volume by one unit each time the voltage indicates that the resistance at the variable resistor 146*a* has reached $R_{FD}$, and will decrease the volume by one unit each time the voltage indicates that the resistance at the variable resistor 146*b* has reached $R_{FD}$. The magnitude of the unit will depend upon factors such as program settings, patient settings, and the hearing assistance device employed. For example, some programs set the maximum volume to be 120% of the patient's most comfortable level ("MCL") and the minimum volume to be 10% of the MCL. Here, the magnitude of the unit, in some exemplary implementations, may be about 5% of the MCL. In other implementations, the unit may be measured in dBs. The increases and decreases will continue until the upper and lower volume limits have been reached. Partial presses of the outer member 117 will not result in volume changes in this implementation.

Figure 7:
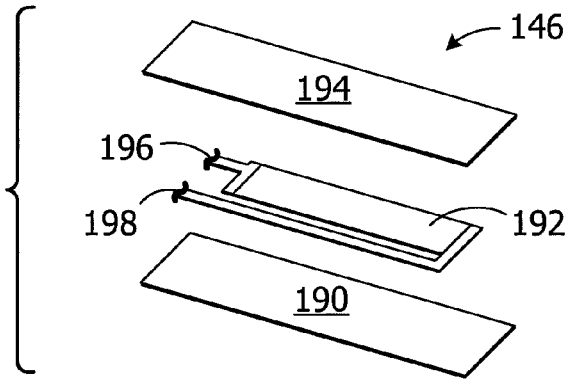
FIG. 7 is an exploded view of one example of a variable resistor that may be incorporated into at least some embodiments of the present inventions.

The individual components of the exemplary variable resistor 146 are illustrated in FIG. 7. The exemplary variable resistor 146 includes a flexible substrate 190, a strip of conductive variable resistance material 192, a protective layer 194 (e.g., a layer of thin, flexible, electrically insulating material), and first and second conductors 196 and 198 that are connected to opposite ends of the strip of variable resistance material. The protective layer 194 may be omitted in some embodiments. The resistance of the conductive material 192 between the conductors 196 and 198 increases as the conductive material is deflected and the resistance between the conductors may be measured in the manner described above. Variable resistors 146*a* and 146*b* have the same configuration. Suitable deflectable variable resistors include the BEND SENSOR® from Flexpoint Sensor Systems in Draper Utah.

Figure 8:
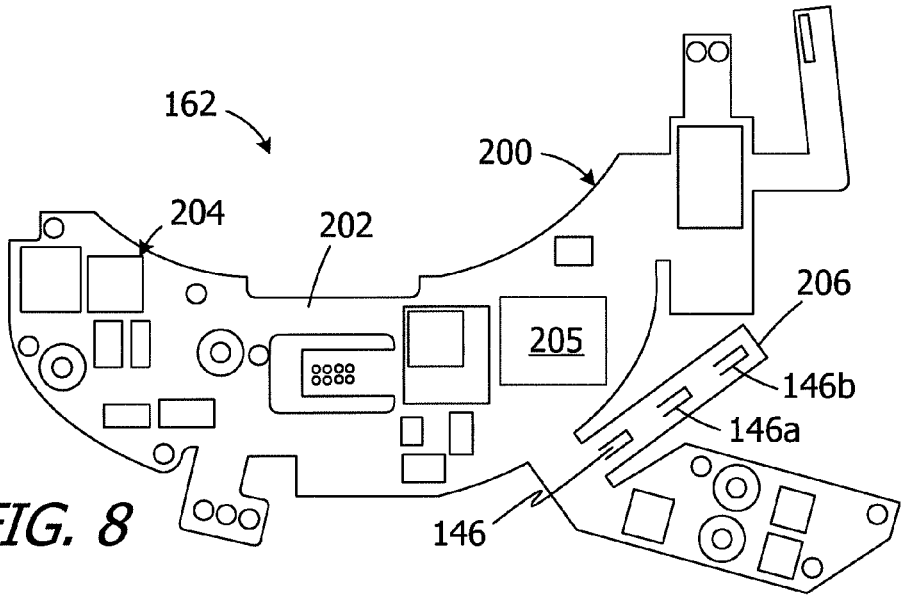
FIG. 8 is a plan view of a printed circuit board in accordance with one embodiment of a present invention.
Figure 9:
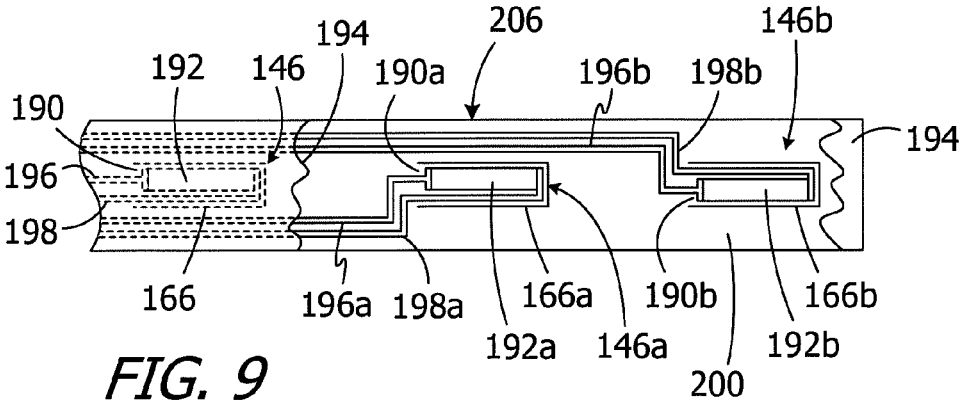
FIG. 9 is a plan, cutaway view of a portion of the printed circuit board illustrated in FIG. 8.

As illustrated for example in FIGS. 8 and 9, the exemplary printed circuit board 162 includes a flexible substrate 200 (e.g., a polyimide sheet or film) with a main portion 202 and a plurality of electronic components 204 on the main portion. Such electronic components 204 may include, but are not limited to, capacitors, resistors, inductors, transistors, diodes, transformers, integrated circuits (such as sound processor circuitry 205), hybrid sub-assemblies, and electrical connectors. The flexible substrate 200 also includes a resistor support portion 206 that includes the variable resistors 146-146*b*. The respective locations of the variable resistors 146-146*b* and components 204 are such that they will not interfere with the folding of the printed circuit board 162. The variable resistors 146-146*b* will be aligned with the remainder of the control panel 110 when the printed circuit board 162 is folded and positioned within the housing 104.

In the illustrated implementation, the flexible substrate 200 generally, and the resistor support portion 206 in particular, forms part of the variable resistors 146-146*b*. The flexible substrate 190-190*b* of each of the variable resistors 146-146*b* is a part of the flexible substrate 200 (e.g., is part of the resistor support portion 206 of the flexible substrate 200) that is bordered by the associated discontinuities 166-166*b*. The strips of conductive variable resistance material 192-192*b* are carried by the resistor support portion 206 and are connected to the conductors 196-196*b* and 198-198*b*. For example, the strips 192-192*b* may be formed by printing an appropriate carbon/polymer ink onto substrate 200. The conductors 196-196*b* and 198-198*b* extend form the variable resistors 146-146*b*, along the resistor support portion 206 of the flexible substrate 200, and to the main portion 202 where they are connected to the appropriate electronic components. The conductors 196-196*b* and 198-198*b* may also be printed. The protective layer 194, which covers the strips of conductive variable resistance material 192-192*b* and conductors 196-196*b* and 198-198*b*, extends from one end of the resistor support portion 206 to the other.

As alluded to in the preceding paragraph, the variable resistors 146-146*b* in the illustrated implementation are an integral part of the printed circuit board 162. As used herein, "an integral part of" means that variable resistors 146-146*b* and the electronic components 204 share a single common flexible substrate. In the illustrated implementation, the flexible substrate 200, including the resistor support portion 206 that itself includes the flexible substrates 190-190*b*, is formed from a single sheet of printed circuit board material (e.g., a multi-layer printed circuit board formed from polyimide sheets or films) that is cut or otherwise manufactured into the desired shape. The variable resistors 146-146*b* in the illustrated implementation are not carried on a separate printed circuit board that is connected to another printed circuit board with male and female connectors or other electromechanical connectors. During manufacture, the flexible substrate 200 is cut to the desired shape, then the variable resistors 146-146*b* are printed onto the substrate and, in some instances covered with the protective layer 194, then the electronic components 204 are positioned on the substrate main portion 202, and then, in some instances, a moisture resistant and electrically insulating conformal coating is applied over the substrate main portion 202 and electrical components 204. Alternatively, the electronic components 204 may be positioned on the substrate main portion 202 prior to the printing of the variable resistors 146-146*b*.

Figure 10:
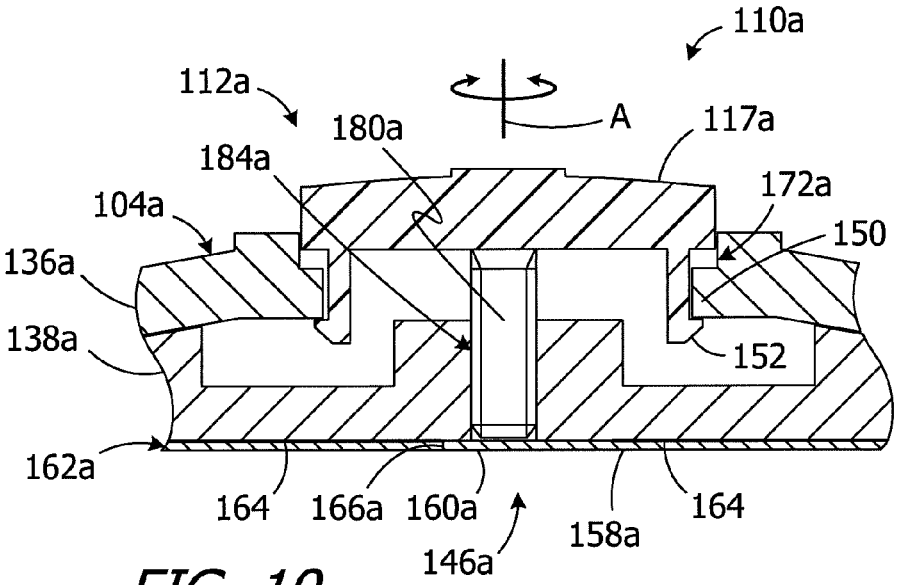
FIG. 10 is a partial section view of a rotatable potentiometer in accordance with one embodiment of a present invention in a minimum resistance state.

Other types of control panel user manipulatable elements, which include a variable resistor, may be employed in place of one or more of above-described switches. As illustrated in FIG. 10, the exemplary control panel 110*a* may be incorporated into the BTE unit 100 (FIGS. 1 and 2) in place of control panel 110. The control panel 110*a* is substantially similar to control panel 110 and similar elements are represented by similar reference numerals. For example, the control panel 110*a* has a program switch 118 (not shown) and apparatus for volume control. Here, however, the volume control apparatus is in the form of a rotatable potentiometer 112*a* with a single deflectable variable resistor 146*a* that may be used in place of the dual-switch rocker-type volume control 112 (FIGS. 2 and 6) that has a pair of deflectable variable resistors 146*a* and 146*b*. The rotatable potentiometer 112*a* includes a rotatable knob 117*a* that is secured to an externally threaded post 180*a* and is located within an aperture 172*a* in the external member 136*a* of the housing 104*a*. The threaded post 180*a* is rotatably mounted in a threaded aperture 184*a* that extends through the internal support member 138*a*. A variable resistor 146*a* is positioned adjacent to the post 180*a* in the manner described above. The variable resistor 146*a* is part of a printed circuit board 162*a* that is identical to the printed circuit board 162 but for the fact that printed circuit board 162*a* only includes two variable resistors, variable resistor 162 for the program switch 118 (FIGS. 3 and 4) and variable resistor 146*a* for the rotatable potentiometer 112*a*. The printed circuit board 162*a* is also folded and secured within the housing 104*a* in the manner described above with reference to the printed circuit board 162.

Figure 10A:
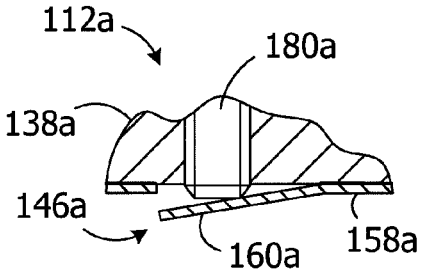
FIG. 10A is a partial section view of a portion of the rotatable potentiometer illustrated in FIG. 10 in an intermediate resistance state.
Figure 10B:
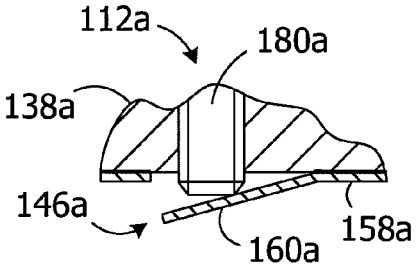
FIG. 10B is a partial section view of a portion of the rotatable potentiometer illustrated in FIG. 10 in a maximum resistance state.

In the illustrated implementation, rotation of the knob 117*a* by the user about the axis A causes axial movement the threaded post 180*a* (and the knob) relative to the housing 104*a*. A retaining ledge 150 and retaining clips 152 together limit movement of the knob 117*a* and post 180*a* to points including and between those illustrated in FIGS. 10 and 10B. Movement of the post 180*a* beyond the position illustrated in FIG. 10 results in deflection of the variable resistor 146*a* from no deflection with the post position illustrated in FIG. 10, to partial deflection with the post position illustrated in FIG. 10A, to full deflection with the post position illustrated in FIG. 10B, and all positions therebetween. The resistance of the variable resistor 146*a* varies in the manner illustrated in FIG. 5 from $R_0$ to $R_{FD}$, as does the sensed voltage, as the post 180*a* moves the variable resistor 146*a* from the position illustrated in FIG. 10 to the position illustrated in FIG. 10B. The sound processor circuitry 105 increases and decreases the volume as a function of the resistance of the variable resistor 146*a*.

Figure 11:
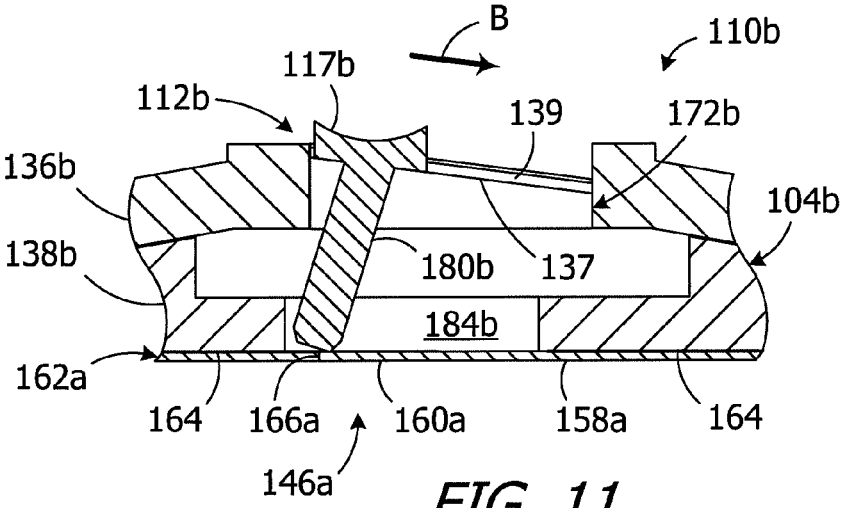
FIG. 11 is a section view of a linear potentiometer in accordance with one embodiment of a present invention in a minimum resistance state.

Turning to FIG. 11, the exemplary control panel 110*b* may be incorporated into the BTE unit 100 (FIGS. 1 and 2) in place of control panel 110. The control panel 110*b* is substantially similar to control panel 110 and similar elements are represented by similar reference numerals. For example, the control panel 110*b* has a program switch 118 (not shown) and apparatus for volume control. Here, however, the volume control apparatus is in the form of a sliding linear potentiometer 112*b* with a single deflectable variable resistor 146*a* that may be used in place of the dual-switch rocker-type volume control 112 (FIGS. 2 and 6) that has a pair of deflectable variable resistors 146*a* and 146*b*. The linear potentiometer 112*b* includes a sliding knob 117*b* that is secured to a post 180*b* and is located within an aperture 172*b* in the external member 136*b* of the housing 104*b*. The external member 136*b* also has a pair of sloped surfaces 137 (one shown) on which portions of the sliding knob 117*b* on opposite sides of the post 180*b* are supported, and a pair of guide grooves 139 that receive guide pins (not shown) on opposite sides of the sliding knob. The post 180*b* extends through an aperture 184*b* in the internal support member 138*b*. A variable resistor 146*a* is positioned adjacent to the post 180*b*. The variable resistor 146*a* is part of the printed circuit board 162*a* that is described above.

In the illustrated implementation, movement of the knob 117*b* by the user in the direction of arrow B causes movement the post 180*b* in the same direction relative to the housing 104*b*. Movement of the knob 117*b* from the position illustrated in FIG. 11 results in deflection of the variable resistor 146*a* (by the post 180*b*) from the illustrated no deflection state, to partial deflection, to full deflection when the knob reaches the opposite end of the aperture 172*b*. Friction between the external member 136*b* and the post 180*b* maintains the post in the location that the user moves it to. The resistance of the variable resistor 146*a* varies in the manner illustrated in FIG. 5 from $R_0$ to $R_{FD}$, as does the sensed voltage, as the knob 117*b* moves and the post 180*b* deflects the variable resistor. The sound processor circuitry 105 increases and decreases the volume as a function of the resistance of the variable resistor 146*a*.

Figure 12:
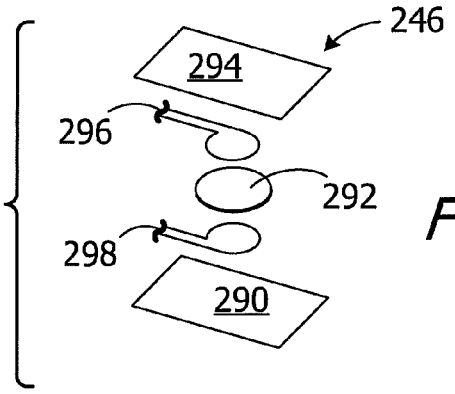
FIG. 12 is an exploded view of one example of a variable resistor that may be incorporated into at least some embodiments of the present inventions.

Another exemplary variable resistor is the piezoresistive device generally represented by reference numeral 246 in FIG. 12. The exemplary variable resistor 246 includes a flexible substrate 290, a sensor region 292 defined by a region of pressure sensitive ink that is printed onto the substrate 290, a flexible substrate 294, and first and second conductors 296 and 298 that are connected to opposite sides of region of pressure sensitive ink. The resistance of the variable resistor 246 decreases as the force applied to the sensor region 292 increases (FIG. 14) and the resistance between the conductors may be measured in the manner described above. Suitable force sensitive variable resistors include the FLEXIFORCE® sensor from Tekscan, Inc. in South Boston, Mass.

Figure 13:
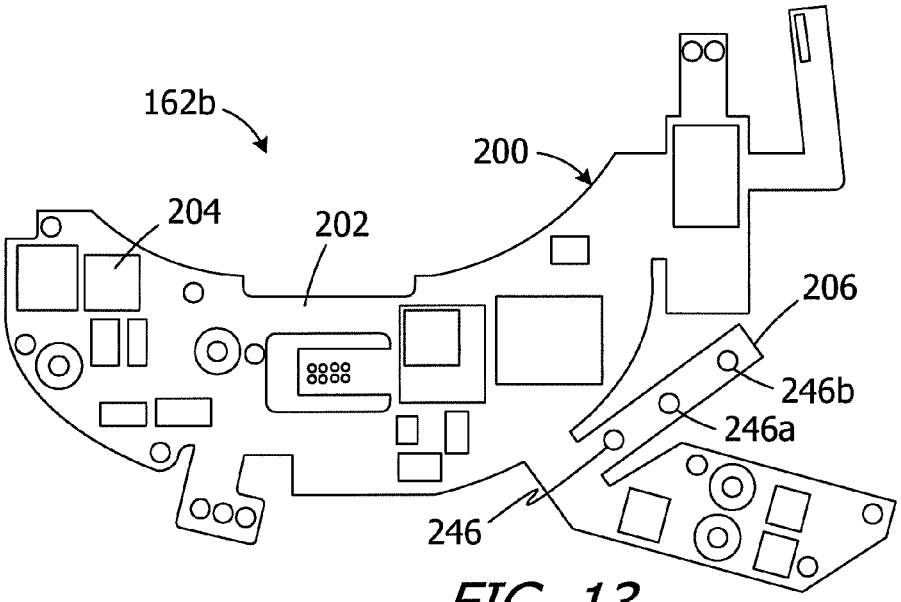
FIG. 13 is a plan view of a printed circuit board in accordance with one embodiment of a present invention.

As illustrated for example in FIG. 13, the exemplary printed circuit board 162*b* includes variable resistors 246-246*b*. Variable resistors 246*a* and 246*b* have the same configuration as variable resistor 246. The printed circuit board 162*b* is essentially identical to printed circuit board 162 and similar elements are represented by similar reference numerals. To that end, the printed circuit board 162*b* includes a flexible substrate 200 (e.g., a polyimide sheet) with a main portion 202, a plurality of electronic components 204 on the main portion, and a resistor support portion 206 that includes the variable resistors 246-246*b*. The flexible substrate 200 generally, and the resistor support portion 206 in particular, forms part of the variable resistors 246-246*b* in the illustrated implementation. The flexible substrate of each of the variable resistors 246-246*b* is a part of the flexible substrate 200 (e.g., is part of the resistor support portion 206 of the flexible substrate 200). Each sensor region (e.g., region 292) is carried by the resistor support portion 206 and is connected to the associated conductors (e.g., conductors 296 and 298), while the conductors are connected to the appropriate circuitry on the remainder of the printed circuit board 162*b*. The protective layer 294 (e.g., a polyimide sheet), extends from one end of the resistor support portion 206 to the other. It should also be noted that the variable resistors 246-246*b* are not configured to deflect away from the remainder of the printed circuit board 162*b*, as are resistors 146-146*b*, and the above-described discontinuities 166-166*b* in the resistor support portion 206 are not present in the printed circuit board 162*b*.

The variable resistors 246-246*b* in the illustrated implementation are an integral part of the printed circuit board 162*b*. The flexible substrate 200, including the resistor support portion 206 that itself includes the flexible substrates of the variable resistors 246-246*b*, is formed from a single sheet of material (e.g. a single sheet of polyimide) that is cut or otherwise manufactured into the desired shape. The variable resistors 246-246*b* in the illustrated implementation are not carried on a separate printed circuit board that is connected to another printed circuit board with male and female connectors or other electromechanical connectors.

Figure 14:
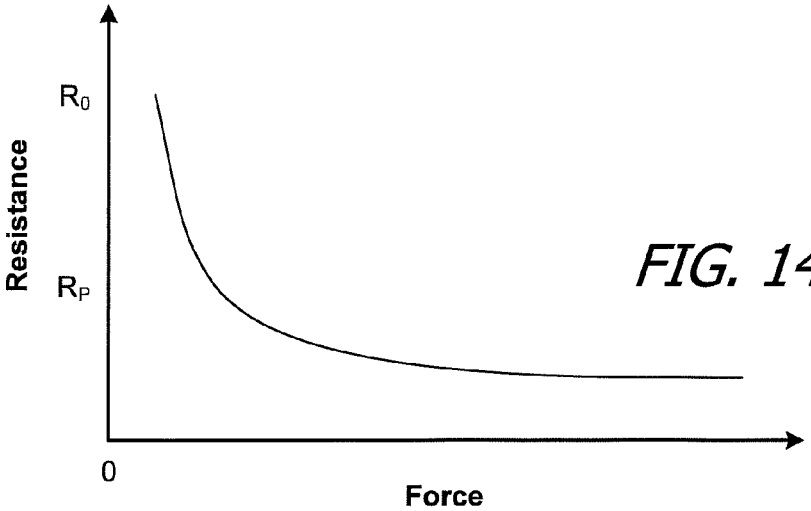
FIG. 14 is a force versus resistance graph.
Figure 15:
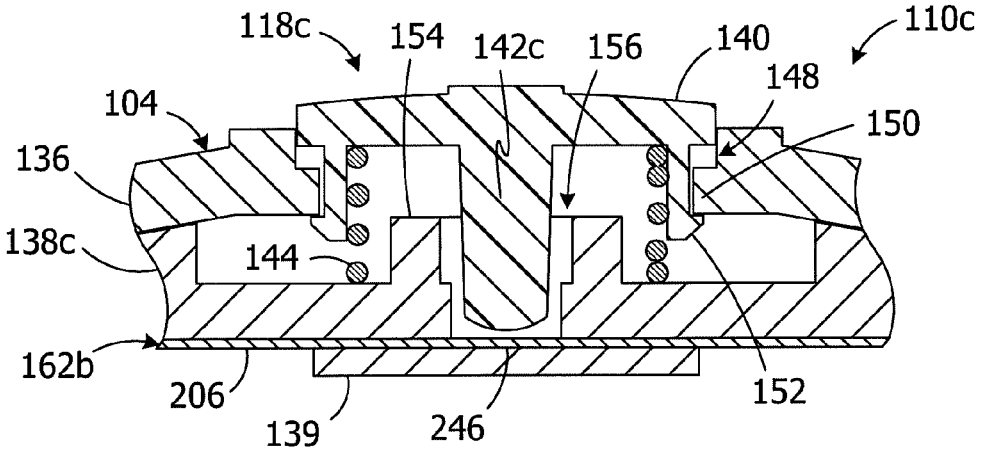
FIG. 15 is a section view of a switch in accordance with one embodiment of a present invention in a non-actuated state.

The printed circuit board 162*b* (with variable resistors 246-246*b*) may also be incorporated into the BTE unit 100 in essentially the same way as the printed circuit board 162. Here, however, support is provided under the variable resistors 246-246*b* so that they may be subjected to compression force instead of being deflected. As illustrated for example in FIG. 15, the exemplary control panel 110*c* may be incorporated into the BTE unit 100 (FIGS. 1 and 2) in place of control panel 110. The control panel 110*c* is substantially similar to control panel 110 and similar elements are represented by similar reference numerals. For example, the control panel 110*c* has a rocker-type volume control 112 (not shown) and a program selection switch 118*c*. Here, however, the internal support member 138*c* includes cantilevered supports 139 (one shown) on which the regions of the resistor support portion 206 that include the variable resistors 246-246*b* are supported. The post 142*c* is also slightly shorter than post 142 and is out of contact with the variable resistor 246 when the switch 118*c* is in the non-actuated state illustrated in FIG. 15, as are the posts on the volume control (not shown). Pressing the push-button 140 results in force being applied to the variable resistor 246 and, in turn, results in the resistance of resistor 246 decreasing from $R_0$ to $R_P$ (FIG. 14). In the illustrated implementation, the sound processor circuitry 105 will change the sound processing program each time the voltage indicates that the resistance at the variable resistor 246 has reached $R_P$. Volume is controlled in similar fashion.

Figure 16:
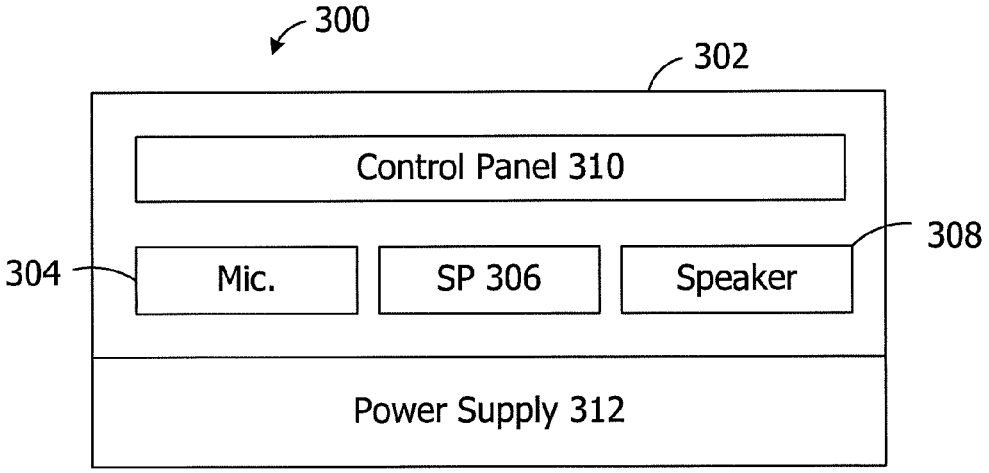
FIG. 16 is a functional block diagram of a hearing aid in accordance with one embodiment of a present invention.

Another example of a hearing assistance device is the BTE hearing aid generally represented by reference numeral 300 in FIG. 16. The exemplary BTE hearing aid 300 includes a housing 302, a microphone 304, sound processor circuitry 306, a speaker 308 and a control panel 310 with components such as an ON/OFF switch and a volume control element. The control panel 310 is configured to employ variable resistors in one or more of the manners described above in the context of control panels 110-110*c*. The BTE hearing aid 300, which has an overall physical configuration (i.e., shape and size) that is similar to the BTE unit 100, also includes the power supply 312, that supplies power to the sound processor circuitry 306 and other power consuming components.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. The inventions also include switches and potentiometers similar to those described above that include variable resistors which are not part of the main printed circuit board. Such switches and potentiometers may be incorporated into control panels of hearing assistance devices in the same manner as those described above but for the use of connectors to electrically connect the variable resistor conductors (e.g., conductors 196 and 198) to a main printed circuit board. It is intended that the scope of the present inventions extend to all such modifications and/or additions and that the scope of the present inventions is limited solely by the claims set forth below.

I claim:

1. A hearing assistance device, comprising:

a housing;

a user manipulatable control element associated with the housing and movable relative to the housing; and a printed circuit board within the housing including a flexible substrate, sound processor circuitry on the flexible substrate, and a variable resistor that is an integral part of the printed circuit board, at least a portion of the variable resistor being deflectable relative to adjacent portions of the printed circuit board;

wherein the variable resistor is positioned adjacent to the control element and is configured such that the resistance of the variable resistor increases with increases in deflection.

2. A hearing assistance device as claimed in claim 1, wherein the sound processor circuitry is configured to adjust an operating parameter in response to the change in variable resistor resistance.

3. A hearing assistance device as claimed in claim 2, wherein the operating parameter comprises volume.

4. A hearing assistance device as claimed in claim 1, wherein the user manipulatable control element defines a first user manipulatable control element and the variable resistor defines a first variable resistor, the hearing assistance device further comprising:

a second user manipulatable control element associated with the housing and movable relative to the housing; and a second variable resistor that is an integral part of the printed circuit board;

wherein the second variable resistor is positioned adjacent to the second control element and is configured such that movement of the second control element results in a change in second variable resistor resistance.

5. A hearing assistance device as claimed in claim 1, wherein the variable resistor includes a portion of the flexible substrate, a variable resistance material located on the portion of the flexible substrate, a first and second conductors connected to the variable resistance material.

6. A hearing assistance device as claimed in claim 5, wherein the variable resistance material comprises a conductive ink.

7. A hearing assistance device as claimed in claim 5, wherein the flexible substrate includes discontinuities that partially border the portion of the flexible substrate on which the variable resistance material is located.

8. A hearing assistance device as claimed in claim 1, further comprising:

a microphone operably connected to the sound processor circuitry; and a headpiece operably connected to the sound processor circuitry and configured to communicate with a cochlear implant.

9. A hearing assistance device as claimed in claim 1, wherein the sound processor circuitry comprises cochlear implant sound processor circuitry.

10. A hearing assistance device as claimed in claim 9, wherein the housing comprises a behind-the-ear sound processor housing with an ear hook.

11. A hearing assistance device as claimed in claim 1, wherein the flexible substrate comprises a multi-layer flexible substrate.

12. A hearing assistance device as claimed in claim 1, wherein the user manipulatable control element comprises a push button that is movable between an actuated position and a non-actuated position and is biased to the non-actuated position.

13. A hearing assistance device as claimed in claim 1, wherein the user manipulatable control element and the variable resistor form a switch.

14. A hearing assistance device as claimed in claim 1, wherein the user manipulatable control element and the variable resistor form a potentiometer.

15. A hearing assistance device as claimed in claim 1, wherein the printed circuit board is folded within the housing.

16. A hearing assistance device as claimed in claim 1, further comprising:

a microphone operably connected to the sound processor circuitry; and a speaker operably connected to the sound processor circuitry.

17. A hearing assistance device, comprising:

a housing;

a printed circuit board within the housing including a flexible substrate, sound processor circuitry on the flexible substrate, and a variable resistor that is an integral part of the printed circuit board; and a user manipulatable control element, associated with the housing and movable relative to the housing, that is configured to apply a compression force to the variable resistor;

wherein the variable resistor is positioned adjacent to the control element and is configured such that the resistance of the variable resistor decreases with increases in the compression force.

18. A hearing assistance device as claimed in claim 17, wherein the sound processor circuitry is configured to adjust an operating parameter in response to the change in variable resistor resistance.

19. A hearing assistance device as claimed in claim 18, wherein the operating parameter comprises volume.

20. A hearing assistance device as claimed in claim 17, wherein the user manipulatable control element defines a first user manipulatable control element and the variable resistor defines a first variable resistor, the hearing assistance device further comprising:

a second user manipulatable control element associated with the housing and movable relative to the housing; and a second variable resistor that is an integral part of the printed circuit board;

wherein the second variable resistor is positioned adjacent to the second control element and is configured such that movement of the second control element results in a change in second variable resistor resistance.

21. A hearing assistance device as claimed in claim 17, wherein the variable resistor includes a portion of the flexible substrate, a variable resistance material located on the portion of the flexible substrate, a first and second conductors connected to the variable resistance material.

22. A hearing assistance device as claimed in claim 21, wherein the variable resistance material comprises a conductive ink.

23. A hearing assistance device as claimed in claim 17, further comprising:

a microphone operably connected to the sound processor circuitry; and a headpiece operably connected to the sound processor circuitry and configured to communicate with a cochlear implant.

24. A hearing assistance device as claimed in claim 17, wherein the sound processor circuitry comprises cochlear implant sound processor circuitry.

25. A hearing assistance device as claimed in claim 24, wherein the housing comprises a behind-the-ear sound processor housing with an ear hook.

26. A hearing assistance device as claimed in claim 17, wherein the flexible substrate comprises a multi-layer flexible substrate.

27. A hearing assistance device as claimed in claim 17, wherein the user manipulatable control element comprises a push button that is movable between an actuated position and a non-actuated position and is biased to the non-actuated position.

28. A hearing assistance device as claimed in claim 17, wherein the user manipulatable control element and the variable resistor form a switch.

29. A hearing assistance device as claimed in claim 17, wherein the printed circuit board is folded within the housing.

30. A hearing assistance device as claimed in claim 17, further comprising:

a microphone operably connected to the sound processor circuitry; and a speaker operably connected to the sound processor circuitry.

* * * * *